US005501163A

United States Patent [19]

Molder et al.

[11] Patent Number: 5,501,163

[45] Date of Patent: Mar. 26, 1996

[54] SYSTEM FOR HOLDING A TUBULAR WORKPIECE IN AN EMBROIDERY MACHINE

[75] Inventors: Karl-Peter Molder, Gonbach; Wolfgang Teetz, Kerken; Rolf Zieschang, Duisburg, all of Germany

[73] Assignee: ZKS-Stickmaschinen Gesellschat mit beschrankter Haftung, Krefeld, Germany

[21] Appl. No.: 422,979

[22] Filed: Apr. 17, 1995

Related U.S. Application Data

[63] Continuation-in-part of Ser. No. 935,048, Aug. 25, 1992, abandoned.

[30] Foreign Application Priority Data

Nov. 21, 1991 [DE] Germany ..... 9114488 U

[51] Int. Cl.[6] ..... D05B 21/00; D05C 3/02

[52] U.S. Cl. ..... 112/102; 112/308; 112/470.18; 112/318

[58] Field of Search ..... 112/102, 103, 112/102.5, 308, 318, 470.06, 470.09, 470.14, 470.18

[56] References Cited

U.S. PATENT DOCUMENTS

| | | | |
|---|---|---|---|
| 3,750,186 | 7/1973 | Sakamoto | 112/102 X |
| 3,905,315 | 9/1975 | Sasaki | 112/102 X |
| 4,114,545 | 9/1978 | Manabe et al. . | |
| 4,359,009 | 11/1982 | Bennison | 112/102 X |
| 4,653,415 | 3/1987 | Tajima | 112/308 X |
| 4,665,844 | 5/1987 | Shibata | 112/103 |
| 4,686,916 | 8/1987 | Mathias | 112/308 X |
| 4,730,566 | 3/1988 | Brophy et al. . | |
| 4,998,964 | 3/1991 | Golia | 112/103 X |
| 5,167,194 | 12/1992 | Nakagaki | 112/103 |
| 5,415,116 | 5/1995 | Nishio | 112/103 |

*Primary Examiner*—Paul C. Lewis
*Attorney, Agent, or Firm*—Herbert Dubno; Andrew Wilford

[57] ABSTRACT

An embroidery machine having a stationary stitching free arm, a pattern transfer element, and a frame having an edge and adapted to hold a workpiece to be embroidered, is used with a holding system having a support coupled longitudinally to the transfer element and movable on the frame in a longitudinal direction relative to the station. A pair of outer wheels on the support flanking the station are rotatable about respective axes generally parallel to the longitudinal direction. A center wheel on the support vertically offset from and generally between the outer wheels is rotatable about a respective axis generally parallel to the longitudinal direction. The frame edge can be engaged on one side by the outer wheels and on the other side by the center wheel to hold it in the station. A drive rotates one of the wheels, normally the center wheel, and thereby displaces the workpiece and frame held by the wheels in a direction transverse to the longitudinal direction. The outer wheels normally are movable vertically on the support. A spring urges at least one of the wheels, normally both the outer wheels, vertically toward another of the wheels so that the frame does not have to be deformed to be fitted between the wheels.

14 Claims, 12 Drawing Sheets

SYSTEM FOR HOLDING A TUBULAR WORKPIECE IN AN EMBROIDERY MACHINE

CROSS REFERENCE TO RELATED APPLICATION

This application is a continuation-in-part of application 07/935,048 filed 25 Aug. 1992 now abandoned with a claim to German priority document G 91 14 488.4 filed 21 Nov. 1991.

FIELD OF THE INVENTION

The present invention relates to an embroidery machine More particularly this invention concerns a system for holding a tubular workpiece, e.g. a shirt sleeve or cap, in such a machine for automated embroidery thereon.

BACKGROUND OF THE INVENTION

To embroider a pattern on a tubular workpiece it is necessary to fit it to a normally tubular frame that is in turn fitted to a free arm or bed of an embroidery machine. Then as described in U.S. Pat. No. 4,653,415 of Tajima and U.S. Pat. No. 4,665,844 of Shibata longitudinal movement, which here is intended to cover movement parallel to the center axis of the tubular frame, is imparted to the entire frame and its supporting mechanism and transverse movement is effected by rotating the tubular frame on the free arm about its axis. Such a system allows a transfer mechanism or pantograph to accurately guide the workpiece relative to the stationary stitching station so that the desired design can be stitched into the goods.

Such an arrangement is highly effective for small areas of embroidery, but is limited by the size of the window provided in the tubular support frame. In addition for longitudinal movement the entire support structure must be moved along with the frame so that the necessary drive must be able to accurately displace a considerable mass. For transverse movement a fairly complex system of interengaging structure on the frame and on the free arm must be moved to rotate the frame. Hence the drive must be made fairly powerful and must operate fairly slowly to obtain the necessary accuracy. What is more such machines can normally only accommodate a single size of frame so that workpieces of different sizes cannot be accommodated conveniently.

OBJECTS OF THE INVENTION

It is therefore an object of the present invention to provide an improved embroidery machine.

Another object is the provision of such an improved embroidery machine which overcomes the above-given disadvantages that is which can stitch over a relatively large area, and that can use fairly small and fast drives to move the workpiece.

SUMMARY OF THE INVENTION

An embroidery machine having a stationary stitching free arm, a pattern transfer element, and a frame having an edge and adapted to hold a workpiece to be embroidered, is used with a holding system having a support coupled longitudinally to the transfer element and movable on the frame in a longitudinal direction relative to the station. A pair of outer wheels on the support flanking the station are rotatable about respective axes generally parallel to the longitudinal direction. A center wheel on the support vertically offset from and generally between the outer wheels is rotatable about a respective axis generally parallel to the longitudinal direction. The frame edge can be engaged on one side by the outer wheels and on the other side by the center wheel to hold it in the station. A drive rotates one of the wheels, normally the center wheel, and thereby displaces the workpiece and frame held by the wheels in a direction transverse to the longitudinal direction.

According to the invention the outer wheels are normally movable vertically on the support. A spring urges at least one of the wheels, normally both the outer wheels, vertically toward another of the wheels so that the frame does not have to be deformed to be fitted between the wheels.

Thus this system can be used with a frame of virtually any curvature. In fact a flat frame can be used, or a curved frame whose center of curvature lies above the stitching station. The stitch window can be of any desired size, so long as a frame can be made up to hold the workpiece and still provide the desired big window. Furthermore the frame can be a fairly simple device, and there is no significant mechanism employed to hold it in place, so the mass that must be moved is minimized.

According to this invention the one wheel rotatable by the drive means is a toothed wheel. The frame edge is toothed complementary to the toothed wheel. In addition the drive includes a rack extending in the transverse direction and fixed on the transfer element and a gear wheel meshing with the rack and coaxially fixed to the wheel rotatable by the drive means so that relative transverse movement of the transfer element and support is converted into rotation of the drive wheel. The frame edge is formed with at least one laterally projecting ridge and at least one of the wheels is formed with a peripheral groove complementary to and receiving the ridge.

To accommodate fairly large workpieces or frames auxiliary support wheels flanking the outer wheels are carried on the support. In addition each wheel can be associated with a respective auxiliary wheel coaxially spaced from itself but jointly rotatable therewith.

The drive according to the invention can be a drive roller coaxially fixed to the wheel rotatable by the drive means and a flexible element looped around the roller and having ends fixed to the transfer element. It can also be a lever linkage connected between the wheel rotatable by the drive means and the transfer element or a servomotor carried on the support and coupled to the wheel rotatable by the drive means.

The transfer element of this invention is provided with transversely extending guide elements along which the support can slide transversely. Similarly the station is provided with a guide rail extending longitudinally. The support rides on the guide rail.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 10:
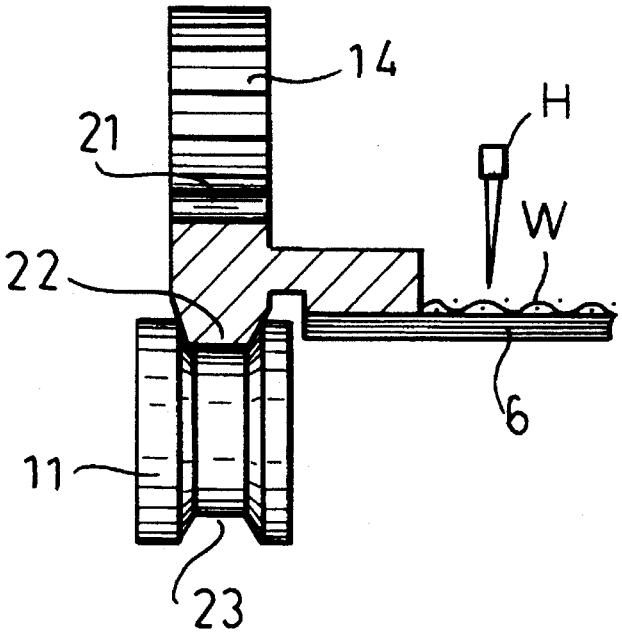
FIG. 10 is a vertical section taken along line X—X of FIG. 4 through a detail of the system of this invention.

As seen in FIGS. 1, 2, 4, and 10 an embroidery machine according to this invention has a large support table i provided here with four stationary stitching stations 2 each constituted by a bed or free arm and, immediately above each of them, a needle-carrying sewing head shown schematically at H in FIG. 10. A transfer element or pantograph 5 is mounted in drives or guides 3 forming part of a drive system for displacing workpieces W at the stations 2 transversely in a direction x relative to the stations 2 and in drives or guides 4 forming part of a drive system for displacing the workpieces W longitudinally in a direction y relative to the stations 2. A controller 25 is connected to the drives 3 and 4 for operating them so as to move the workpieces W in the stationary stitching stations 2. The workpieces W are held in respective arcuate frames 6.

Each station 2 is provided with a frame holder or support 7 that has wheels 9 that ride on a guide rail 8 fixed at the respective station 2 and extending in the longitudinal direction y. The wheels 9 and guide rail 8 act as link means for coupling the holder to the transfer element for joint co-directional movement. Furthermore each support 7 slides on rods 10 fixed on the transfer pantograph 5 and extending parallel to the direction x. Thus as the transfer element 5 moves longitudinally in the direction y it entrains the holders 7 and when it moves transversely in the direction x it moves relative to the holders 7 but this movement is transmitted to the workpieces W as described below.

Figure 4:
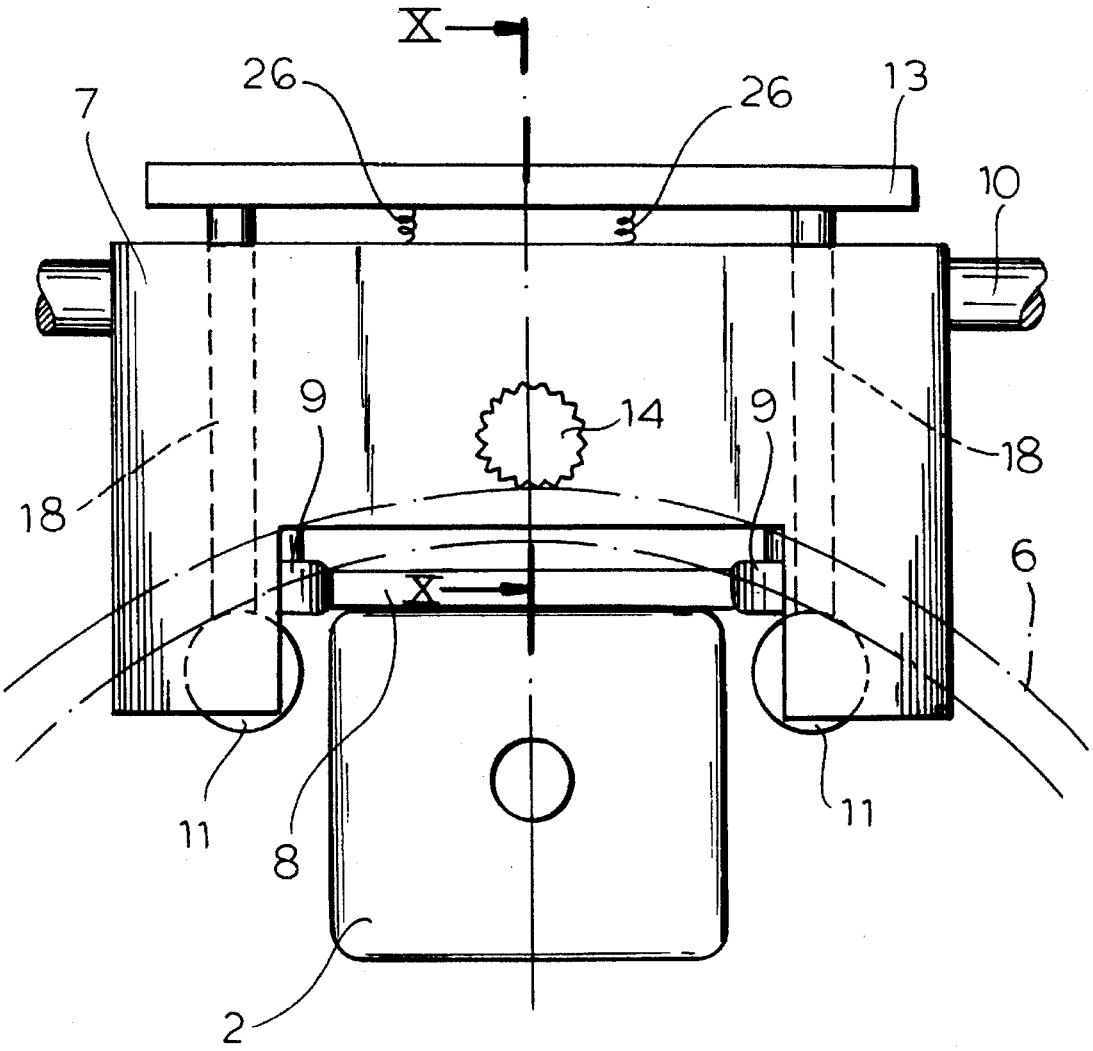
FIG. 4 is a rear end view of the FIG. 2 stitching station.
Figure 7:
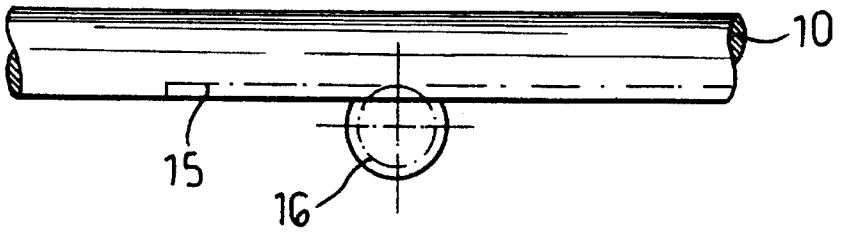
FIGS. 7, 8, and 9 are diagrammatic views showing variations on the system of FIGS. 2 and 4.

According to the invention each arcuate or tubular workpiece-holding frame 6 is held between at least two lower wheels 11 and one upper wheel 14 all rotatable about respective axes parallel to the longitudinal direction y. The lower wheels 11 are horizontally level with each other flanking the station 2 and normally are not driven. The upper wheel 14 is driven. It can be a simple smooth-surface cylindrical wheel for friction drive of the frame 6, or as shown in FIGS. 4 and 10 can have teeth to engage in teeth 21 formed at the edge of the frame 6. This frame edge also has a ridge 22 that can engage downward in radially outwardly open peripheral grooves 23 of the wheels 11 to retain the frame 6 solidly in position. FIG. 7 shows how the wheel 14 is fixed on a coaxial gear 16 riding in a rack 15 formed on one of the rods 10 so that the relative movement of the transfer element 5 and station 2 in the direction x is transmitted as rotation to the respective frame 6.

Figure 5:
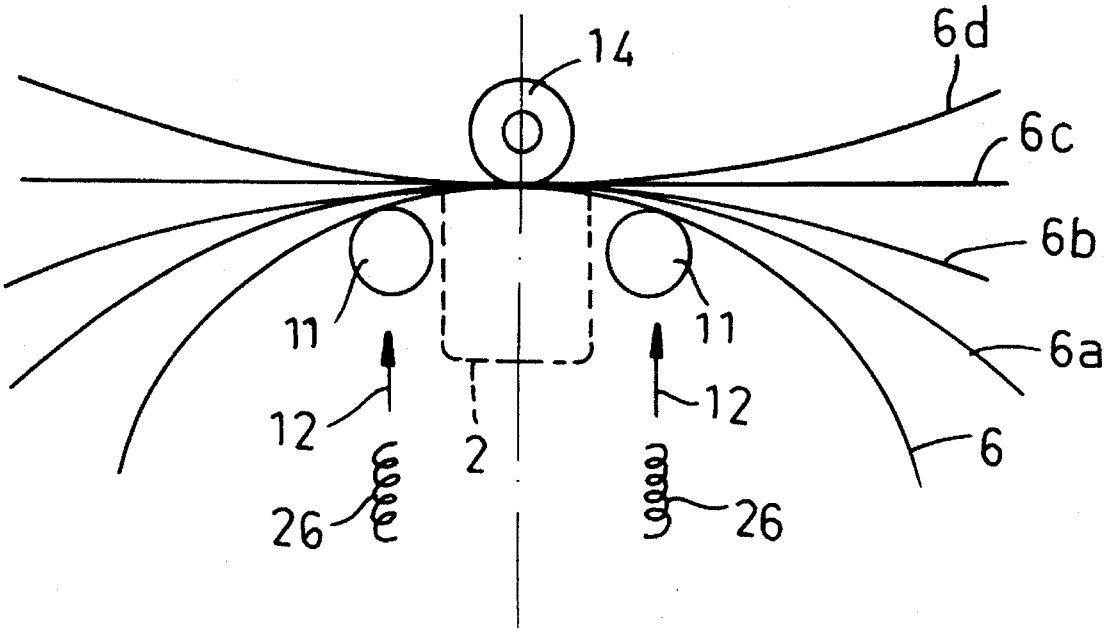
FIG. 5 is a largely diagrammatic front end view illustrating the workpiece-holding system of this invention.
Figure 6:
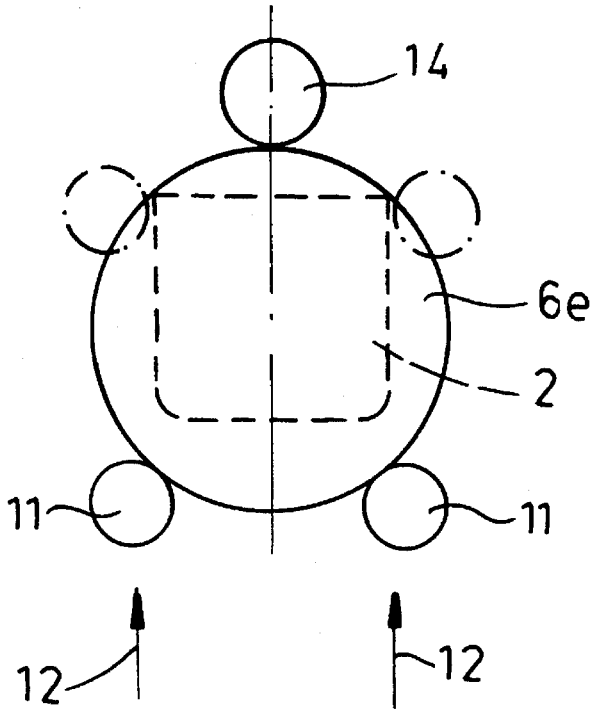
FIG. 6 is another diagrammatic front end view illustrating another use of the system of the invention.
Figure 11:
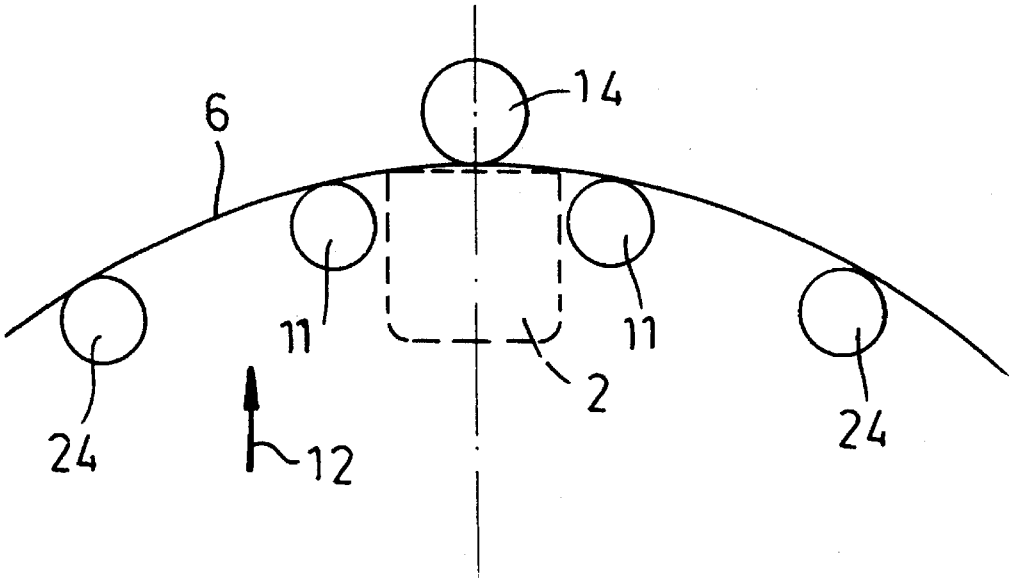
FIG. 11 is a diagrammatic end view like FIGS. 5 and 6 through another system according to the invention.
Figure 12:
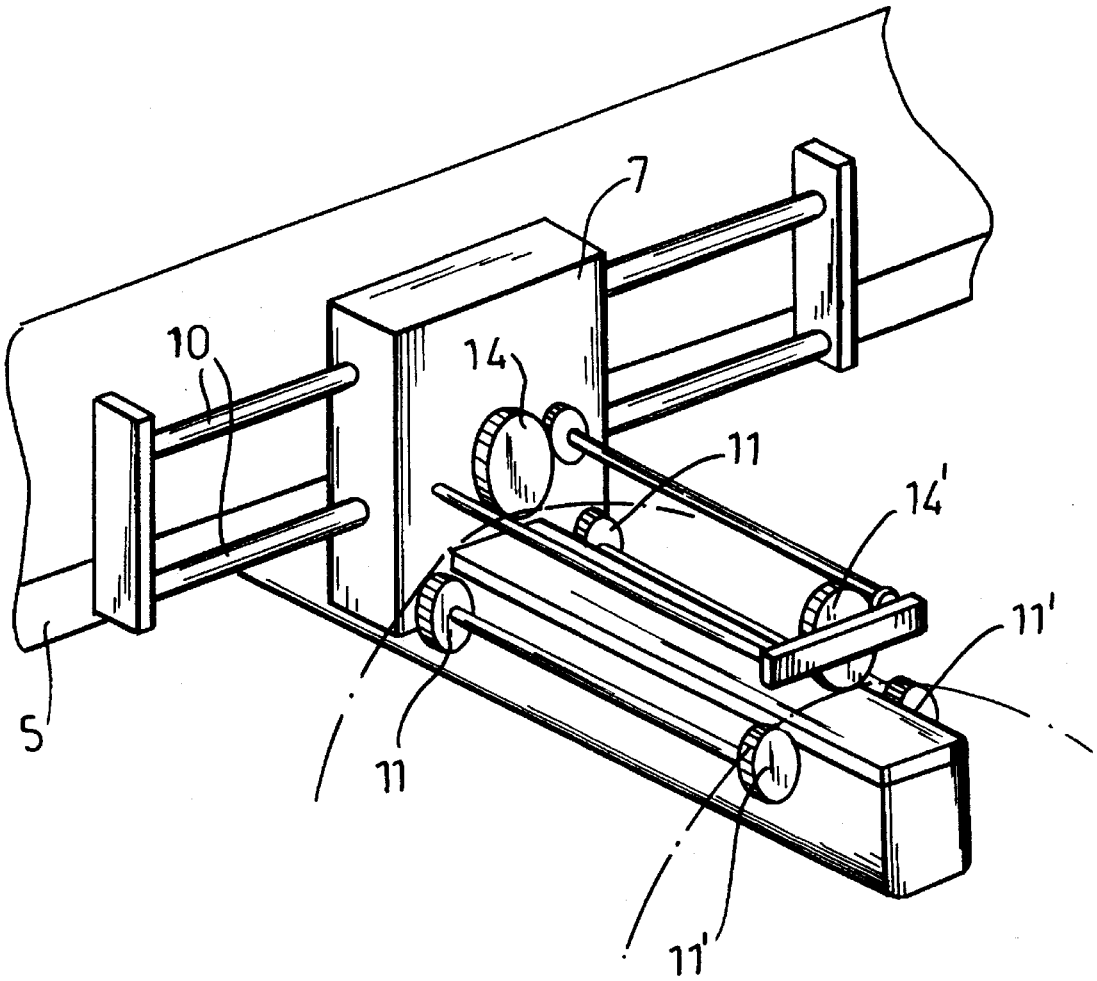
FIG. 12 is a view like FIG. 2 of another variant on the system according to the instant invention.
Figure 13:
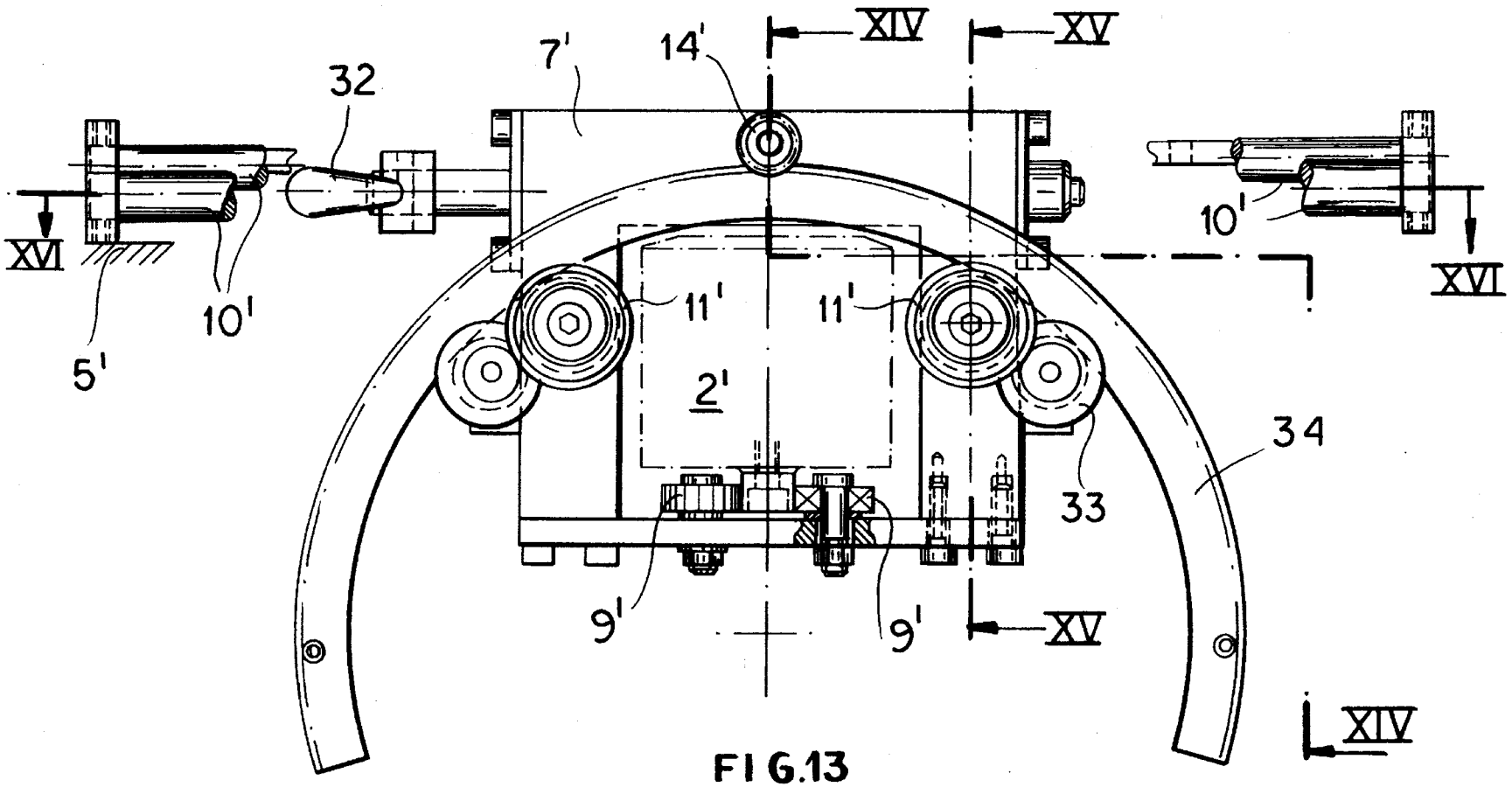
FIG. 13 is a detailed structural front view of the embroidery machine.
Figure 14:
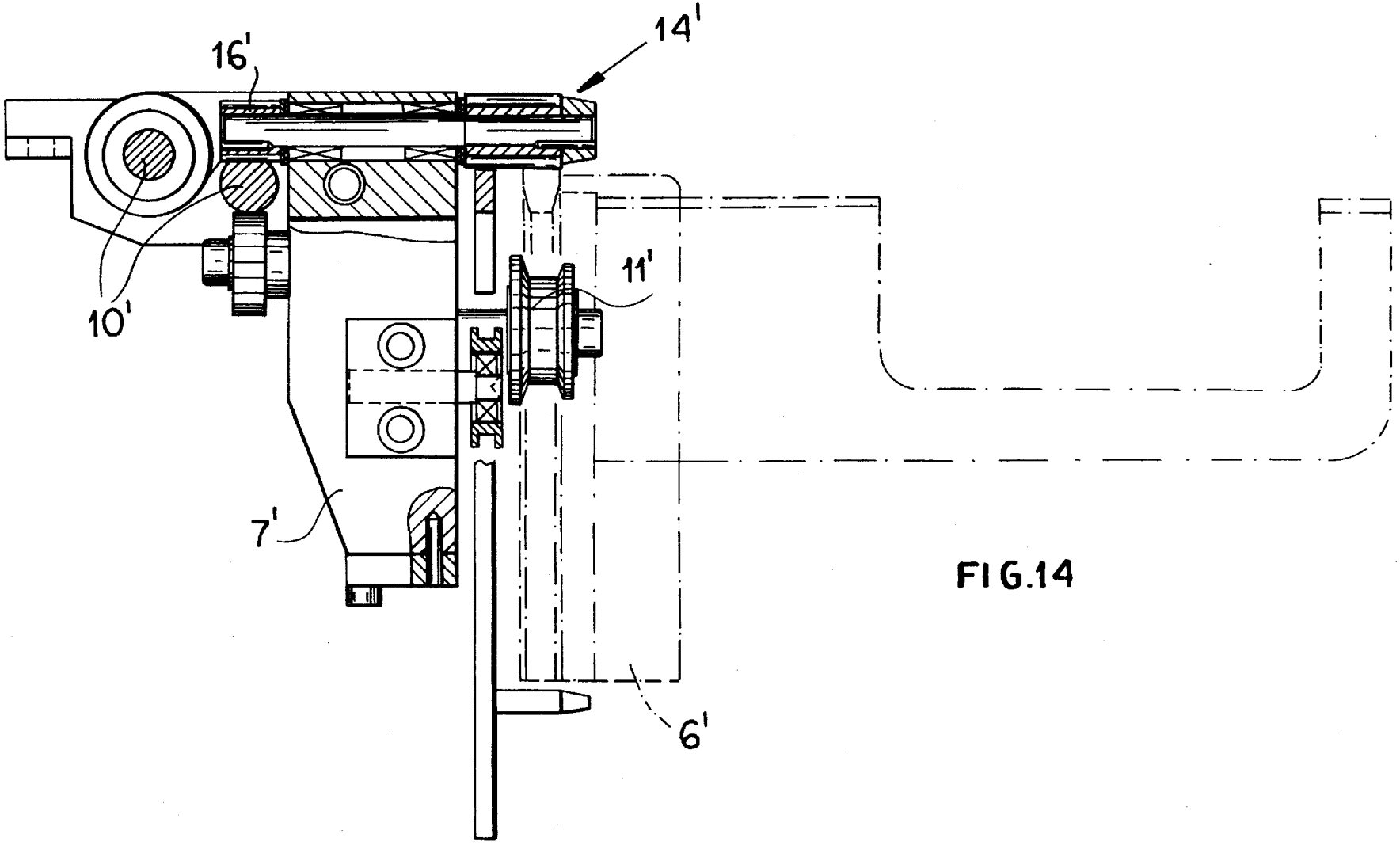
FIGS. 14, 15, and 16 are detailed sectional views taken along respective lines XIV—XIV, XV—XV, and XVI—XVI of FIG. 13.
Figure 15:
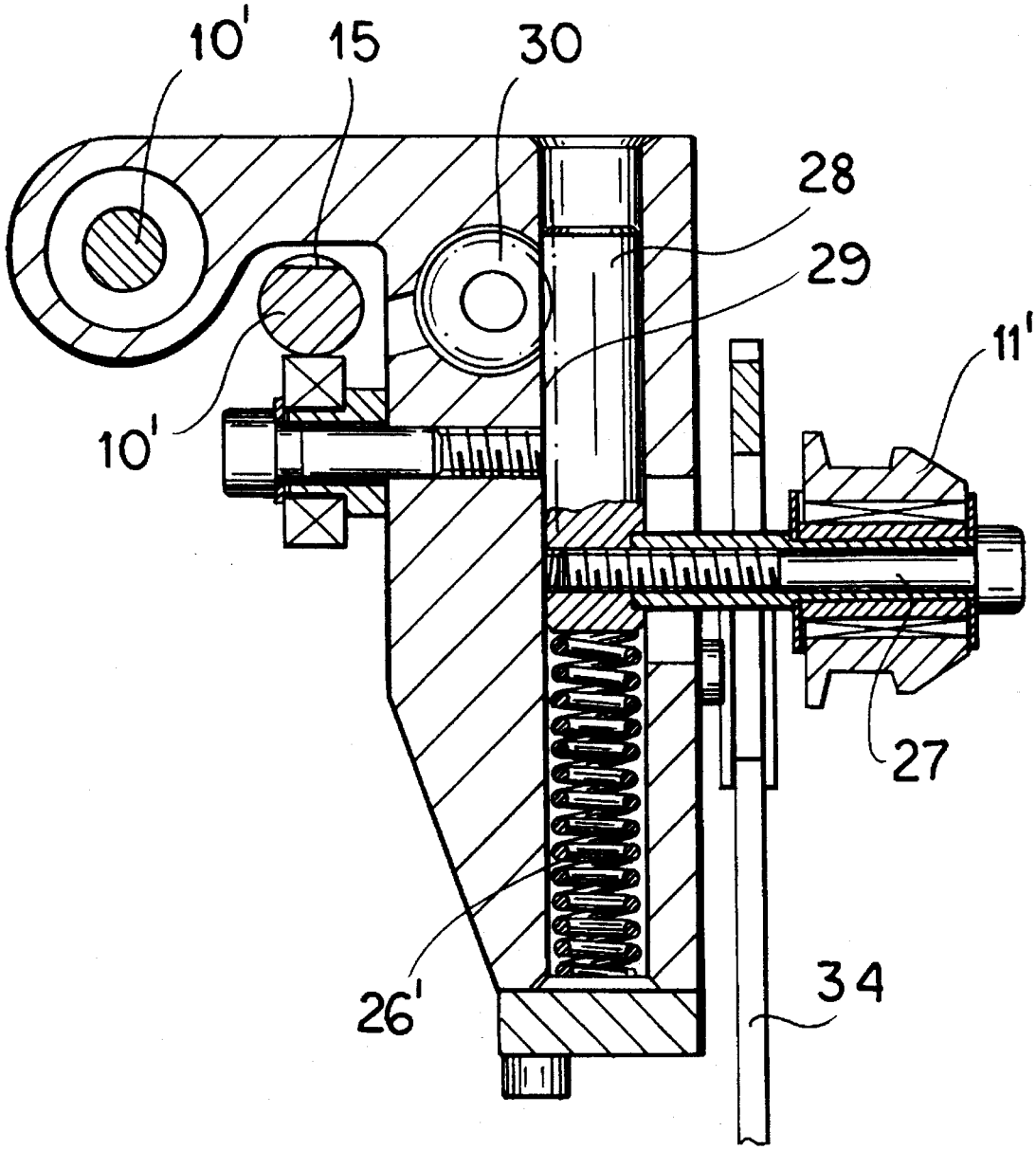
Figure 16:
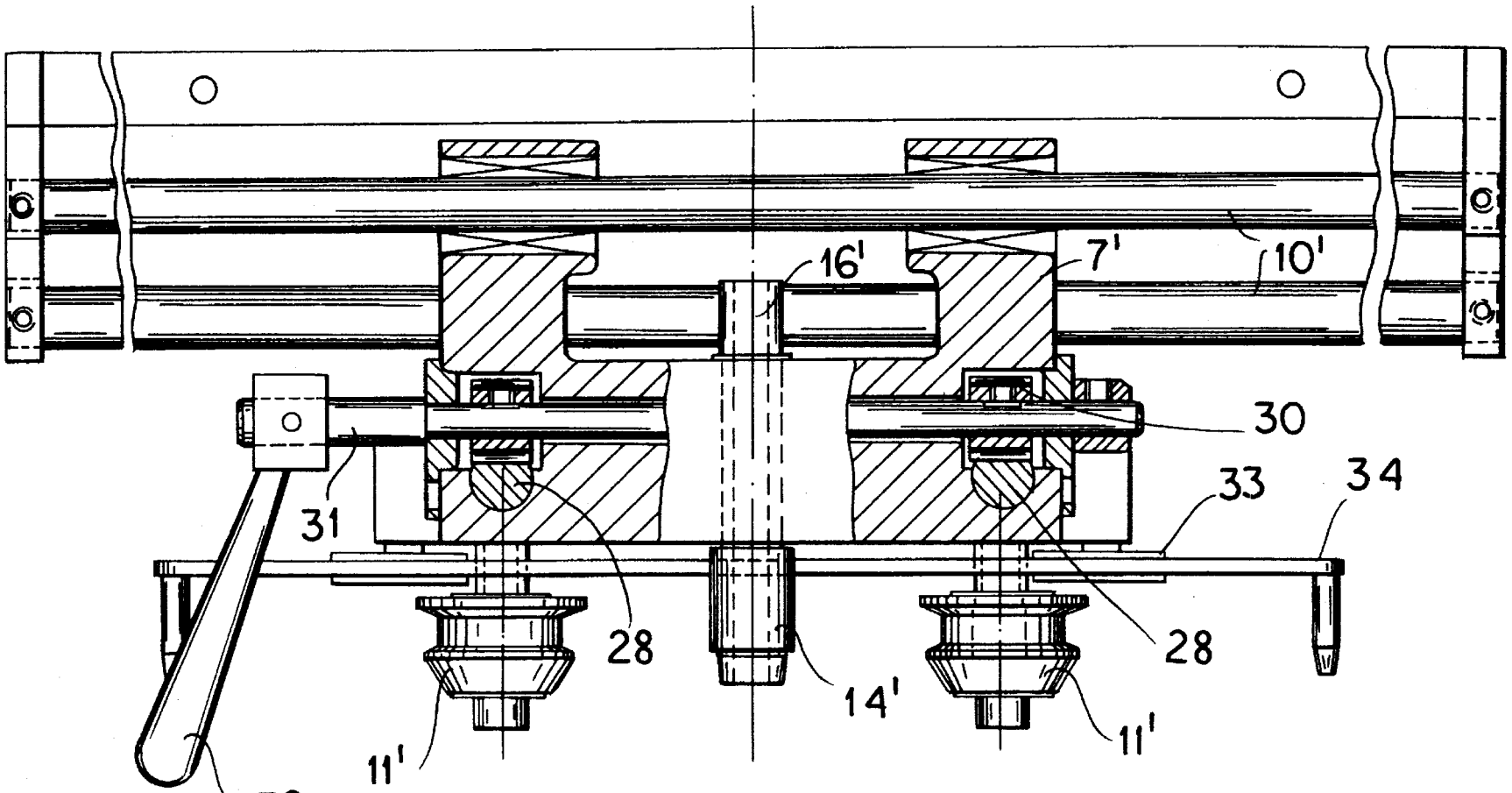

As also illustrated schematically in FIG. 5 the lower wheels 11 are biased upward in direction 12 by springs shown schematically at 26. An element 13 (FIGS. 3 and 4) can be pushed down on top of the holder 7 to push down slides 18 carrying the wheels 11 and allow a frame 6 to be changed. It is possible to accommodate frames **6*a* through 6*c* of different curvatures due to the vertical movability of the wheels 11. In fact a flat frame 6*c* can be used, or the center of curvature of the frame 6 can be oriented above the station 2 as shown for frame 6*d*. It is also possible to engage a small frame 6*e* as shown in FIG. 6 completely between the wheels 11 and 14. For very large or heavy frames it is possible as shown in FIG. 11 to provide auxiliary wheels 24 lying to either side of the wheels 11 and mounted on the support 7 for rotation about axes parallel to those of the wheels 11 and 14. Similarly as shown in FIG. 12 each wheel 11 and 14 can be associated with a respective coaxial wheel 11' or 14' that is synchronously rotatable and coaxial with it, to support long frames 6**.

Figure 3:
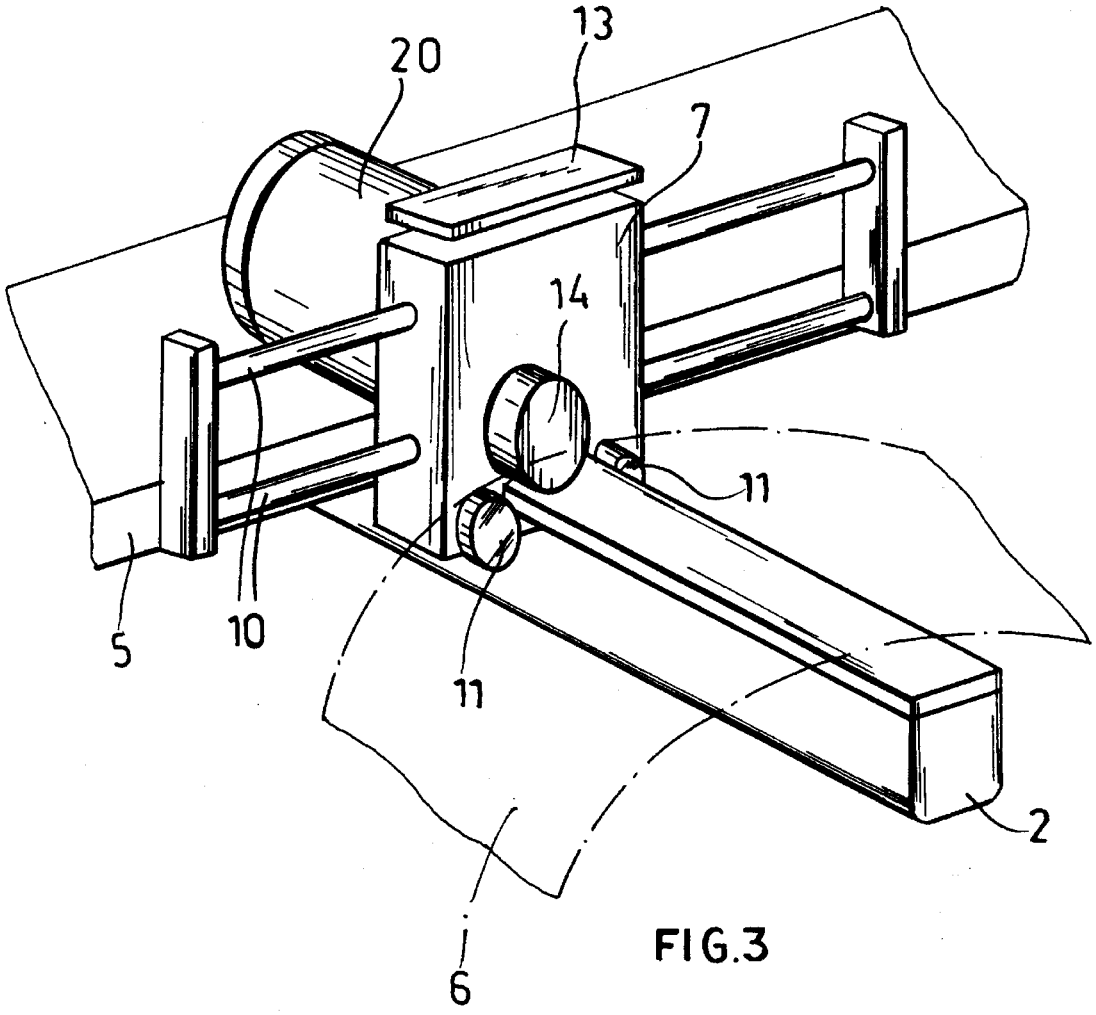
FIG. 3 is a view like FIG. 2 of an alternative arrangement according to the invention.
Figure 8:
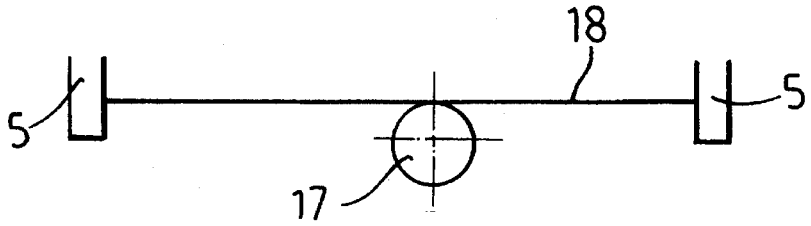
Figure 9:
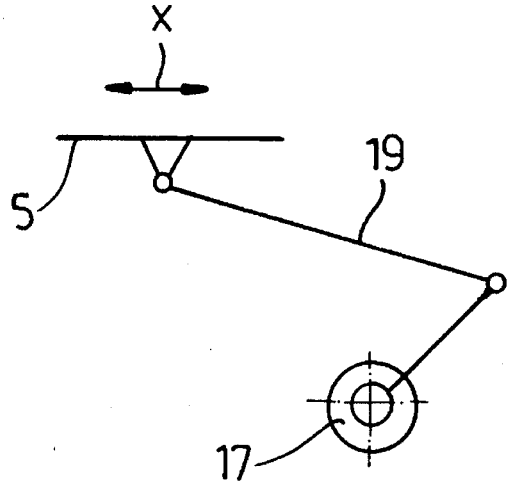

FIG. 8 shows how a flexible element 18 having both ends fixed on the transfer element 5 can be looped around a wheel 17 coaxial with and fixed to the wheel 14 to drive same. Alternately as shown in FIG. 9 the wheel 17 can be connected via a lever linkage 19 to the transfer element 5. It is also possible to drive the wheel 14 directly as shown in FIG. 3 by a servomotor 20 carried on the holder 7, which motor 20 is in turn operated by the controller 25.

Figure 1:
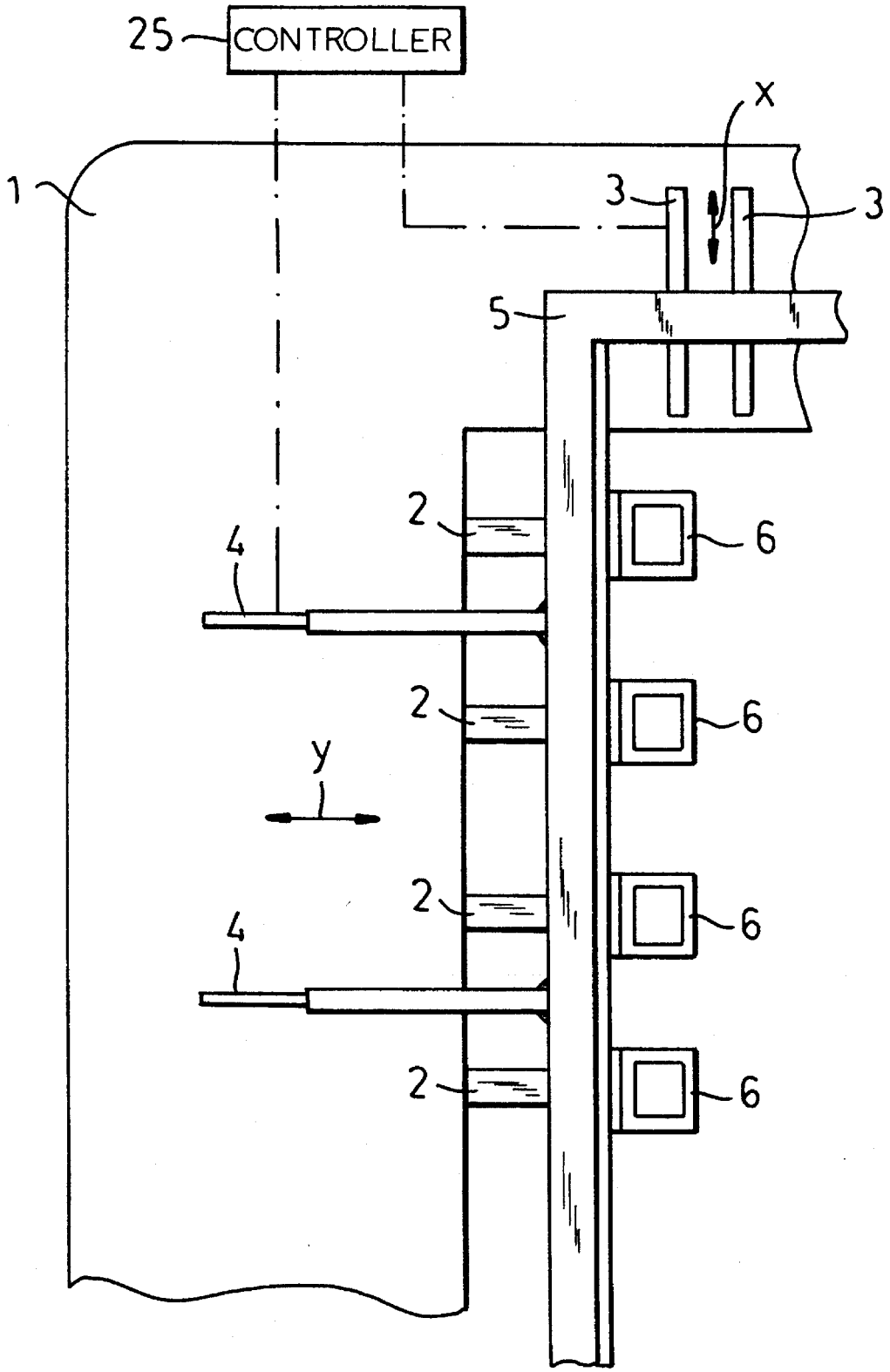
FIG. 1 is a largely diagrammatic top view of a multi-station embroidery machine according to the invention.
Figure 2:
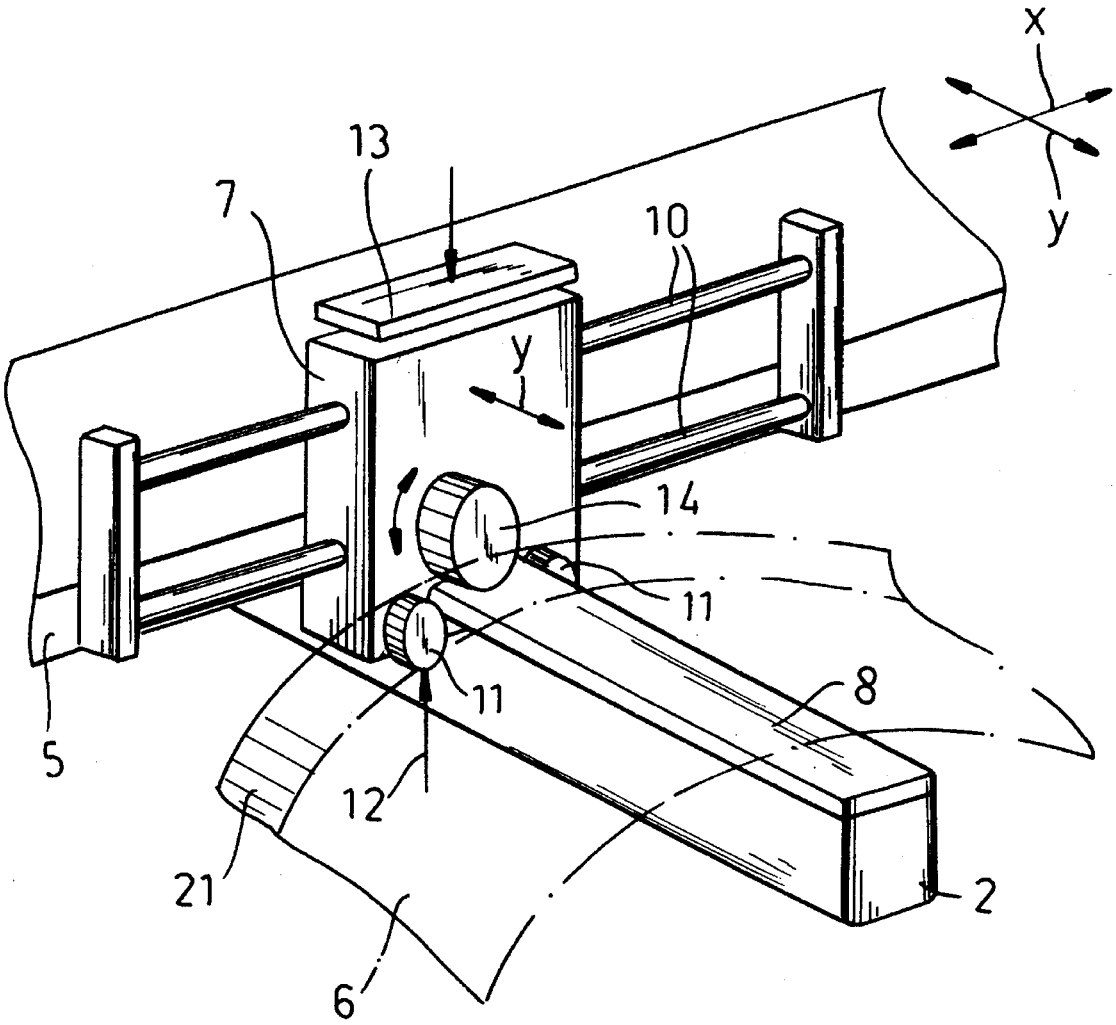
FIG. 2 is a large-scale front perspective view of one of the stitching stations of the machine of FIG. 1.

The arrangement of FIGS. 13–16 corresponds generally to that of FIGS. 1, 4, and 10 with functionally identical parts bearing the same reference numerals but with primes. Here each roller 11' is journaled on a shaft 27 fixed in a respective vertically movable slide 28 formed with a row of teeth 29 meshing with a respective pinion 30. These pinions 30 are both carried on a common shaft 31 provided with a handle 32. Springs 26' urge the slides 28 upward. Angular movement of the handle 32 will displace the rollers 11' downward against the force of the springs 26' and away from the upper roller 14' to allow a frame 6' to be installed in or taken out of the machine. Other rollers or wheels 33 support a centering ring 34 used to align the frame 6'.

We claim:

1. In combination with an embroidery machine having a stationary stitching free arm defining a station, a pattern transfer element movable in longitudinal and transverse directions, and a frame having an edge and adapted to hold a workpiece to be embroidered, a holding system comprising:

a support connected to the transfer element and movable in the longitudinal direction relative to the station;

link means coupling the support to the transfer element for joint codirectional longitudinal movement;

a pair of outer wheels on the support, flanking the station and rotatable about respective axes generally parallel to the longitudinal direction;

a center wheel on the support vertically offset from and generally between the outer wheels and rotatable about a respective axis generally parallel to the longitudinal direction the center and outer wheels cooperating to hold the frame therebetween; and drive means for rotating one of the wheels at a peripheral speed corresponding to transverse movement of the element and thereby displacing the workpiece and frame held by the wheels in direction transverse to the longitudinal direction.

2. The embroidery-machine workpiece-holding system defined in claim 1 wherein the center wheel is the one wheel connected to the drive means and rotated thereby.

3. The embroidery-machine workpiece-holding system defined in claim 1 wherein the one wheel rotatable by the drive means is a toothed wheel, the frame edge being toothed complementary to the toothed wheel.

4. The embroidery-machine workpiece-holding system defined in claim 1 wherein the frame edge is formed with at least one laterally projecting ridge and at least one of the wheels is formed with a peripheral groove complementary to and receiving the ridge.

5. The embroidery-machine workpiece-holding system defined in claim 1, further comprising auxiliary support wheels flanking the outer wheels and journaled on the support.

6. The embroidery-machine workpiece-holding system defined in claim 1 wherein the drive means includes:

a rack extending in the transverse direction and fixed on the transfer element, and a gear wheel meshing with the rack and coaxially fixed to the wheel rotatable by the drive means, whereby relative transverse movement of the transfer element and support is converted into rotation of the drive wheel.

7. The embroidery-machine workpiece-holding system defined in claim 1 wherein the drive means is a servomotor carried on the support and coupled to the wheel rotatable by the drive means.

8. The embroidery-machine workpiece-holding system defined in claim 1 wherein the drive means includes:

a drive roller coaxially fixed to the wheel rotatable by the drive means, and a flexible element looped around the roller and having ends fixed to the transfer element.

9. The embroidery-machine workpiece-holding system defined in claim 1 wherein the drive means includes a lever linkage connected between the wheel rotatable by the drive means and the transfer element.

10. The embroidery-machine workpiece-holding system defined in claim 1 wherein the transfer element includes transversely extending guide elements along which the support can slide transversely.

11. The embroidery-machine workpiece-holding system defined in claim 1 wherein the link means includes a guide rail extending longitudinally, the support riding on the guide rail.

12. The embroidery-machine workpiece-holding system defined in claim 1 wherein each wheel has a respective auxiliary wheel coaxially spaced from itself but jointly rotatable therewith.

13. In combination with an embroidery machine having a stationary stitching free arm defining a station, a pattern transfer element movable longitudinally and transversely at respective variable speeds, and a frame having an edge and adapted to hold a workpiece to be embroidered, a holding system comprising:

a support connected to the transfer element and movable on the frame in a longitudinal direction relative to the station;

link means coupling the support to the transfer element for joint codirectional longitudinal movement;

a pair of lower outer wheels on the support, flanking the station and rotatable about respective axes generally parallel to the longitudinal direction;

an upper center wheel on the support above and generally between the outer wheels and rotatable about a respective axis generally parallel to the longitudinal direction the upper center wheel and the lower outer wheels cooperating to hold the frame therebetween; and drive means for rotating the upper wheel at a peripheral speed corresponding to the speed of movement of the transfer element in the transverse direction and thereby displacing the workpiece and frame held by the wheels in a direction transverse to the longitudinal direction.

14. In combination with an embroidery machine having a stationary stitching free arm defining a station, a pattern transfer element movable in longitudinal and transverse directions, and a frame having an edge and adapted to hold a workpiece to be embroidered, a holding system comprising:

a support connected to the transfer element and movable in the longitudinal direction relative to the station;

link means coupling the support to the transfer element for joint codirectional longitudinal movement;

a pair of outer wheels on the support, flanking the station, rotatable about respective axes generally parallel to the longitudinal direction, and movable vertically on the support;

a center wheel on the support vertically offset from and generally between the outer wheels and rotatable about a respective axis generally parallel to the longitudinal direction;

means including a spring for urging at least one of the wheels vertically toward another of the wheels, whereby the frame edge can be engaged on one side by the outer wheels and on the other side by the center wheel to hold it in the station; and drive means for rotating one of the wheels at a peripheral speed corresponding to transverse movement of the element and thereby displacing the workpiece and frame held by the wheels in direction transverse to the longitudinal direction.

* * * * *

UNITED STATES PATENT AND TRADEMARK OFFICE

CERTIFICATE OF CORRECTION

PATENT NO. : 5,501,163

DATED : March 26, 1996

INVENTOR(S) : Karl-Peter Molder, et. al.

It is certified that error appears in the above-indentified patent and that said Letters Patent is hereby corrected as shown below:

Title page, item [73], Assignee: should read--ZSK-Stickmaschinen Gesellschaft mit beschrankter Haftung, Krefeld, Germany--.

Signed and Sealed this

Twenty-seventh Day of August, 1996

*Attest:*

Bruce Lehman

BRUCE LEHMAN

*Attesting Officer*

*Commissioner of Patents and Trademarks*